US010731917B1

(12) United States Patent
Nuss

(10) Patent No.: US 10,731,917 B1
(45) Date of Patent: Aug. 4, 2020

(54) REFRIGERATOR APPLIANCE WITH ARTICULATING DRAWER FRONT

(71) Applicant: Haier US Appliance Solutions, Inc., Wilmington, DE (US)

(72) Inventor: Bart Andrew Nuss, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/564,227

(22) Filed: Sep. 9, 2019

(51) Int. Cl.

| | |
|---|---|
| ***F25D 25/02*** | (2006.01) |
| ***F25D 23/02*** | (2006.01) |
| ***A47B 88/00*** | (2017.01) |
| ***A47B 88/944*** | (2017.01) |

(52) U.S. Cl.
CPC ..... *F25D 25/025* (2013.01); *A47B 88/944* (2017.01); *F25D 23/021* (2013.01); *F25D 23/028* (2013.01); *A47B 2210/175* (2013.01)

(58) Field of Classification Search
CPC .... F25D 23/021; F25D 23/028; F25D 25/025; F25D 2323/02; F25D 2323/024; A47B 88/0044; A47B 88/944; A47B 2210/17; A47B 2210/175
See application file for complete search history.

(56) References Cited

U.S. PATENT DOCUMENTS

| | | | | |
|---|---|---|---|---|
| 4,654,930 | A | 4/1987 | Lautenschlager, Jr. et al. | |
| 6,243,918 | B1 * | 6/2001 | Zetti | E05D 3/16 16/293 |
| 7,591,516 | B2 | 9/2009 | Kim et al. | |
| 7,886,407 | B2 * | 2/2011 | Resnik | E05D 3/16 16/286 |
| 7,987,558 | B2 * | 8/2011 | Beckmann | E05F 1/1253 16/366 |
| 8,955,352 | B2 * | 2/2015 | Lee | F25D 23/02 312/273 |
| 2010/0090575 | A1 * | 4/2010 | Uthuppan | F25D 23/04 312/404 |

FOREIGN PATENT DOCUMENTS

| | | | | |
|---|---|---|---|---|
| CN | 108868422 | A * | 11/2018 | F25D 23/028 |
| EP | 2754982 | A1 * | 7/2014 | F25D 23/028 |
| JP | 2017020718 | A * | 1/2017 | F25D 25/025 |
| KR | 1020050057863 | A * | 6/2005 | F25D 23/02 |
| WO | WO2018075094 | A1 | 4/2018 | |

* cited by examiner

*Primary Examiner* — Andrew M Roersma
(74) *Attorney, Agent, or Firm* — Dority & Manning, P.A.

(57) ABSTRACT

A refrigerator appliance includes a cabinet and a drawer slidably mounted within the cabinet. The drawer includes a drawer body and a door attached to the drawer body via a linkage such that the door is movable relative to the drawer body between a closed position and an open position.

14 Claims, 9 Drawing Sheets

REFRIGERATOR APPLIANCE WITH ARTICULATING DRAWER FRONT

FIELD

The present disclosure relates generally to refrigerator appliances, and more particularly to refrigerator appliances which include a drawer having a tilt out drawer front feature.

BACKGROUND

Refrigerator appliances generally include a cabinet that defines chilled chambers for receipt of food items for storage. One or more insulated, sealing doors are provided for selectively enclosing the chilled food storage chambers. Consumers generally prefer chilled chambers that facilitate visibility and accessibility of food items stored therein.

In certain refrigerator appliances, commonly referred to as side-by-side style refrigerator appliances, the fresh food chamber is positioned next to the freezer chamber within the cabinet. Such a configuration can permit easy access to food items stored on doors of the refrigerator appliances. However, the cabinet can be deep and narrow such that accessing food items at a back of the fresh food chamber and/or freezer chamber is difficult.

In other refrigerator appliances, the freezer chamber is positioned either above or below the fresh food chamber in the cabinet, which are commonly referred to as top mount or bottom mount refrigerator appliances. Such a configuration can provide a relatively wide fresh food chamber and/or freezer chamber, e.g., as compared to the side-by-side configuration. However, the depth of the fresh food chamber and the freezer chamber can make accessing food items at a back of the refrigerator appliance difficult.

Accordingly, a refrigerator appliance with features for assisting with accessing food items stored therein would be useful.

BRIEF DESCRIPTION

Additional aspects and advantages of the technology will be set forth in part in the following description, or may be apparent from the description, or may be learned through practice of the technology.

In accordance with one embodiment, a refrigerator appliance is provided. The refrigerator appliance includes a cabinet defining a fresh food storage chamber and a frozen food storage chamber and a drawer slidably mounted within one of the fresh food storage chamber and the frozen food storage chamber. The drawer includes a drawer body defining an interior of the drawer and a door attached to the drawer body via a linkage such that the door is movable relative to the drawer body between a closed position where the door encloses the interior of the drawer and an open position to provide access to the interior of the drawer.

In accordance with another embodiment, a drawer for a refrigerator appliance is provided. The refrigerator appliance includes a cabinet defining a fresh food storage chamber and a frozen food storage chamber. The drawer is slidably mountable within one of the fresh food storage chamber and the frozen food storage chamber. The drawer includes a drawer body defining an interior of the drawer and a door attached to the drawer body via a linkage such that the door is movable relative to the drawer body between a closed position where the door encloses the interior of the drawer and an open position to provide access to the interior of the drawer.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures.

Figure 1:
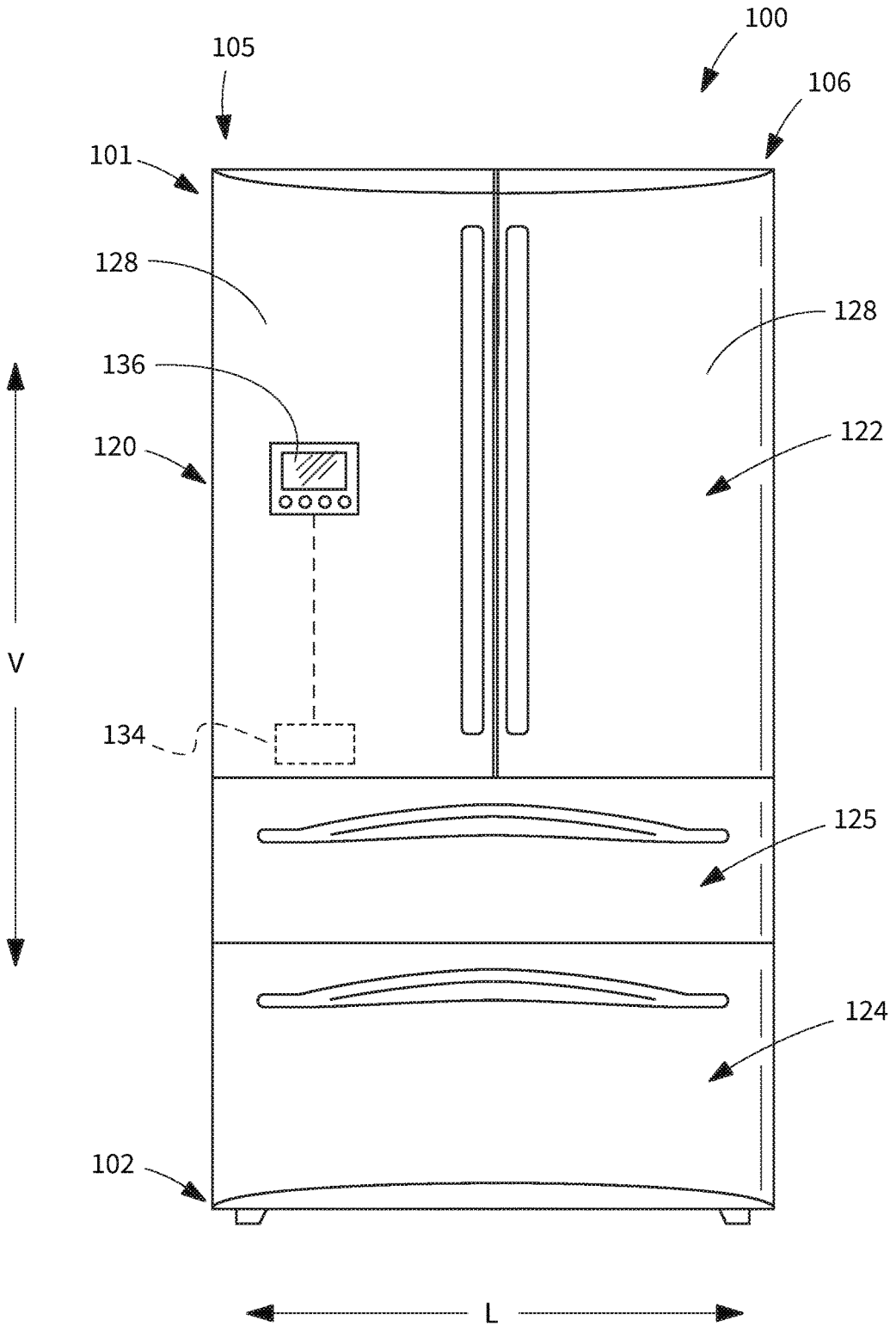
FIG. 1 provides a front view of a refrigerator appliance according to one or more exemplary embodiments of the present subject matter.

Repeat use of reference characters in the present specification and drawings is intended to represent the same or analogous features or elements of the present subject matter.

DETAILED DESCRIPTION

Reference now will be made in detail to embodiments of the technology, one or more examples of which are illustrated in the drawings. Each example is provided by way of explanation of the technology, not limitation of the technology. In fact, it will be apparent to those skilled in the art that various modifications and variations can be made in the present technology without departing from the scope or spirit of the technology. For instance, features illustrated or described as part of one embodiment can be used with another embodiment to yield a still further embodiment. Thus, it is intended that the present technology covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees either clockwise or counterclockwise with the vertical direction V.

Figure 2:
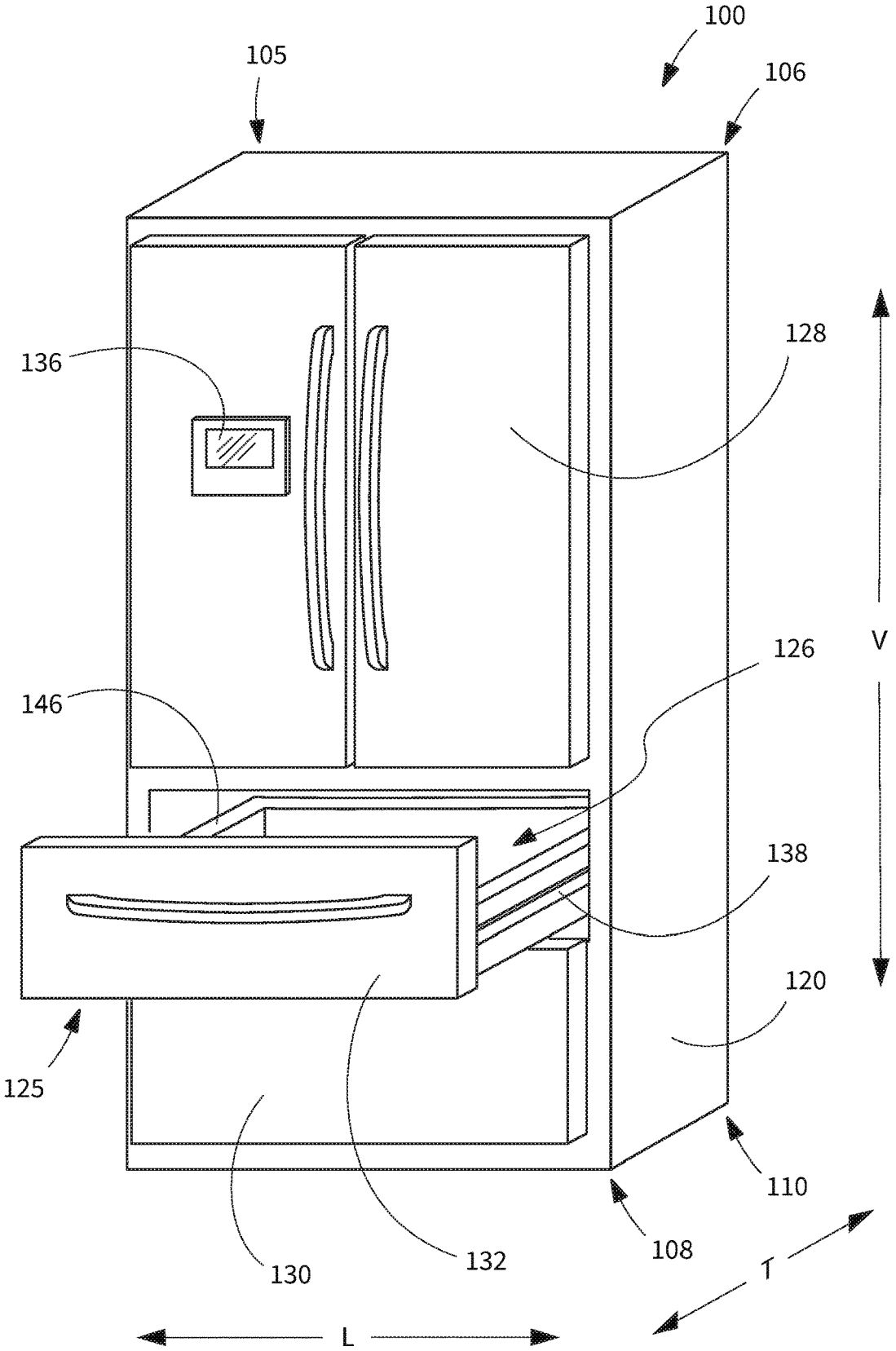
FIG. 2 provides a perspective view of the refrigerator appliance of FIG. 1 with a drawer thereof in an extended position and a door of the drawer in a closed position.
Figure 3:
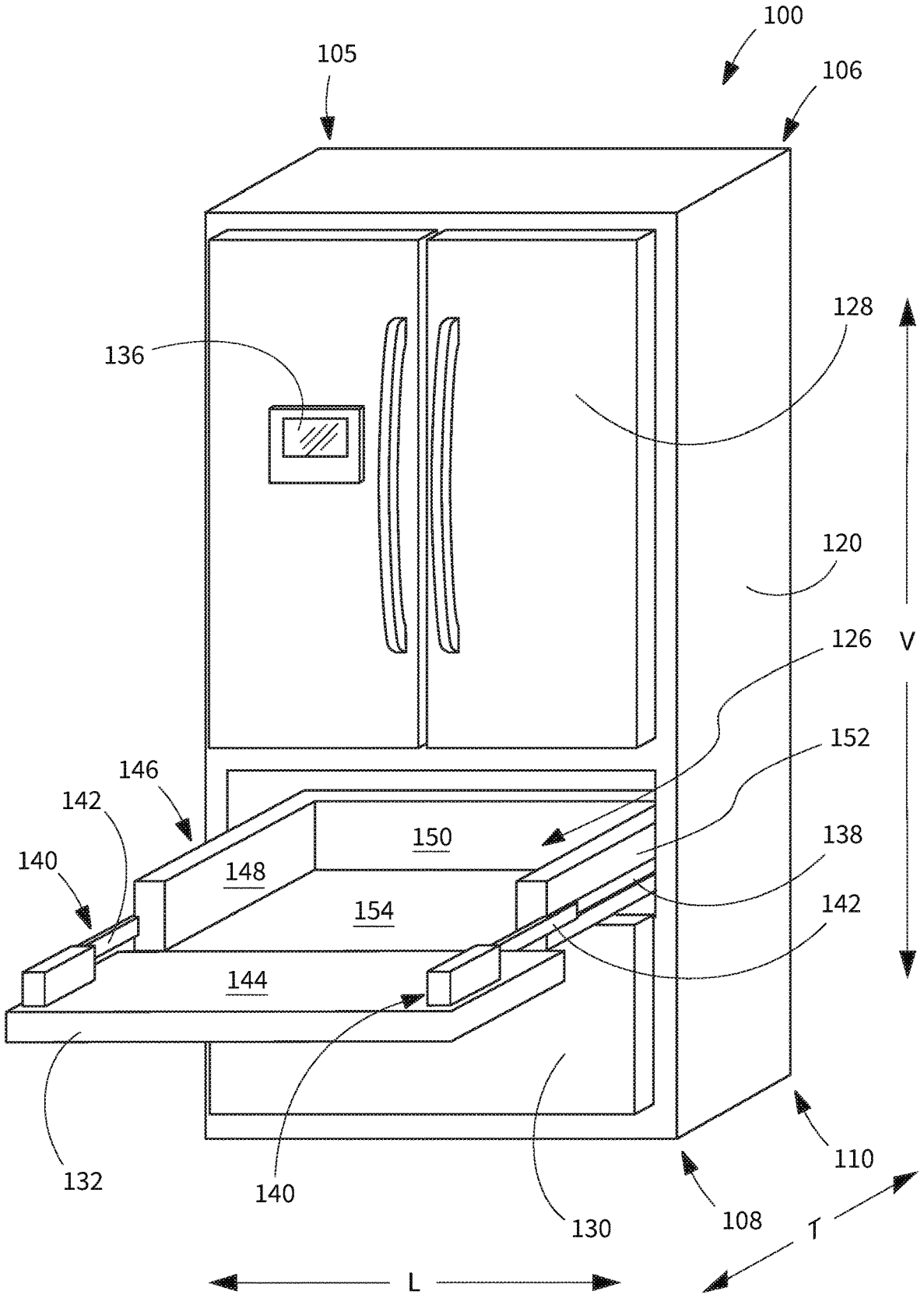
FIG. 3 provides a perspective view of the refrigerator appliance of FIG. 2 with the door of the drawer in an open position.

FIG. 1 is a front view of an exemplary embodiment of a refrigerator appliance 100. FIG. 2 is a perspective view of the refrigerator appliance 100 having a drawer 125 in an open position to reveal the interior 126 of the drawer 125. FIG. 3 is a perspective view of the refrigerator appliance 100 having a door 132 of the drawer 125 in an open position to promote access to the interior 126 of the drawer 125. Refrigerator appliance 100 extends between a top 101 and a bottom 102 along a vertical direction V. Refrigerator appliance 100 also extends between a left side 105 and a right side 106 along a lateral direction L. As shown in FIGS. 2 and 3, a transverse direction T may additionally be defined perpendicular to the vertical and lateral directions V, L. Refrigerator appliance 100 extends along the transverse direction T between a front portion 108 and a back portion 110.

Refrigerator appliance 100 includes a cabinet or housing 120 defining an upper fresh food chamber 122 and a lower freezer chamber or frozen food storage chamber 124 arranged below the fresh food chamber 122 along the vertical direction V. Because the frozen food storage chamber 124 is positioned below the fresh food storage chamber 122, refrigerator appliance 100 is generally referred to as a bottom mount refrigerator. Using the teachings disclosed herein, one of skill in the art will understand that the present technology can be used with other types of refrigerators (e.g., side-by-sides) or a freezer appliance as well. Consequently, the description set forth herein is for illustrative purposes only and is not intended to limit the invention in any aspect.

Refrigerator doors 128 are rotatably hinged to an edge of housing 120 for accessing fresh food chamber 122. It should be noted that while two doors 128 in a "French door" configuration are illustrated, any suitable arrangement of doors utilizing one, two or more doors is within the scope and spirit of the present disclosure. A freezer door 130 is arranged below refrigerator doors 128 for accessing freezer chamber 124. In the exemplary embodiment, freezer door 130 is coupled to a freezer drawer (not shown) slidably coupled within freezer chamber 124.

Operation of the refrigerator appliance 100 can be regulated by a controller 134 that is operatively coupled to a user interface panel 136. Panel 136 provides selections for user manipulation of the operation of refrigerator appliance 100 such as e.g., temperature selections. In response to user manipulation of the user interface panel 136, the controller 134 operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller 134 may be positioned in a variety of locations throughout refrigerator appliance 100. In the illustrated embodiment, the controller 134 may be located within one of the doors 128. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 134 via one or more signal lines or shared communication busses.

FIGS. 2 and 3 illustrate one example embodiment of a drawer 125 for the refrigerator appliance 100. The drawer 125 may be slidably mounted within the cabinet 120, e.g., with slides 138. The drawer 125 may thereby be slidable between a retracted (e.g., closed) position where the door 132 of the drawer 125 is proximate the cabinet 120, e.g., the door 132 may be sealingly engaged with the cabinet 120 by gaskets 156 (FIG. 4) when in the retracted position, and an extended (e.g., open) position where the door 132 of the drawer 125 is spaced apart from the cabinet 120. In other embodiments, the drawer 125 may be an internal drawer without gaskets 156 and the door 132 of the drawer 125 may be proximate the front portion 108 of the cabinet 120 while the door 132 and the remainder of the drawer 125 are fully inside the cabinet 120 in the retracted position. In the illustrated example, the drawer 125 is a freezer drawer slidably mounted within the frozen food storage chamber 124 of the refrigerator appliance 100. Accordingly, the drawer 125 may assist with storing and providing access to frozen food items. For example, smaller food items such as a bag of frozen vegetables may be stored in the freezer drawer 125 to prevent or reduce such items from being obscured under or behind larger items such as a frozen turkey, etc., as compared to when only a single portion of the refrigerator appliance 100 is provided for storing frozen items. In other embodiments, the drawer 125 may be slidably mounted within the fresh food storage chamber 122 and may provide similar advantages with respect to storing and accessing fresh food items.

As will be described in more detail below, the drawer 125 may have a tilt out drawer front, e.g., the door 132 of the drawer 125 may be connected to a drawer body 146 with a linkage 140 comprising a plurality of bars 142 interconnected by pivot joints such that the door 132 is movable, e.g., articulable and/or rotatable, relative to the drawer body 146, e.g., between a closed position (FIG. 2) and an open position (FIG. 3).

As best seen in FIG. 3, the drawer 125 may include a drawer body 146 which includes a left wall 148, a back wall 150, a right wall 152, and a floor 154. The drawer body 146 at least partially defines an interior 126 of the drawer 125 which may provide a storage volume, e.g., for food items. For example, in the illustrated embodiments, the interior 126 of the drawer 125 is collectively defined by the drawer body 146 and the door 132. To promote accessibility of such food items which may be stored within the interior 126 of the drawer 125, the door 132 of the drawer 125 may be movable relative to the drawer body 146, to an open position as shown in FIG. 3. The door 132 may be movable relative to the drawer body 146 in that the door 132 may be connected to the drawer body 146 by one or more linkages 140.

For example, as shown in FIG. 3, the door 132 may be connected to the drawer body 146 by a pair of linkages 140, such as a left linkage 140 including one or more bars 142 connecting the left side wall 148 of the drawer body 146 to the door 132 and a right linkage 140 including one or more bars 142 connecting the right side wall 152 of the drawer body 146 to the door 132. In some embodiments, the drawer 125 may be slidably mounted within the cabinet 120, e.g., within one of the fresh food storage 122 chamber and the frozen food storage chamber 124, by a left slide 138 on the left side wall 148 and a right slide 138 on the right side wall 152, such that the drawer 125 can slide between the retracted position of the drawer 125 (FIG. 1) and the extended position of the drawer 125 (FIGS. 2 and 3). Additionally one or more gaskets 156 (FIG. 4) may be provided on the door 132 of the drawer 125 to sealingly engage the cabinet 120 when the drawer 125 is in the closed position. As shown, the linkages 140 may each be connected to a corresponding slide 138 at each side wall of the drawer body 146.

Figure 4:
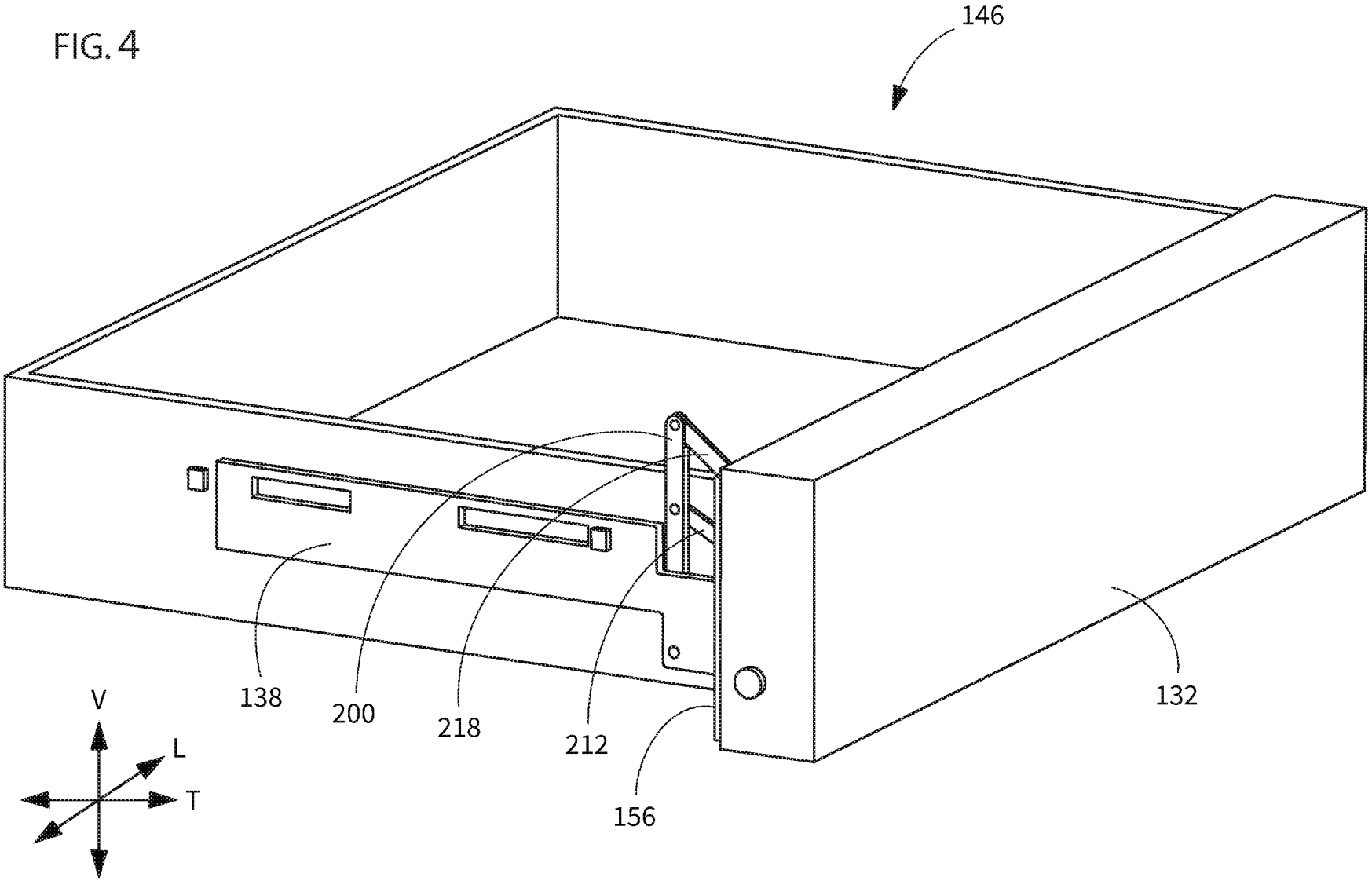
FIG. 4 provides a perspective view of the drawer of FIG. 2.
Figure 5:
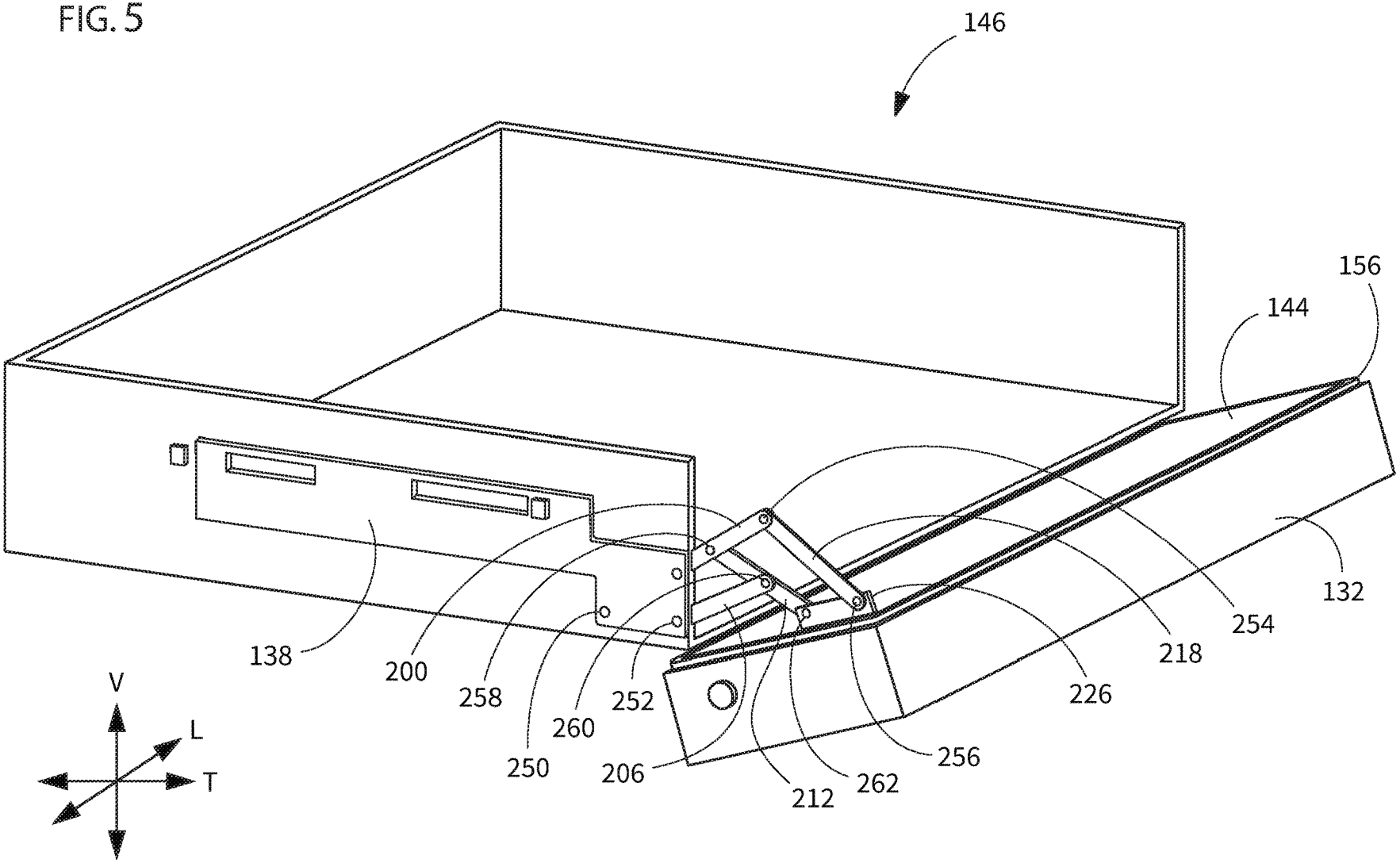
FIG. 5 provides a perspective view of the drawer of FIG. 2 with the door of the drawer in an intermediate position.
Figure 6:
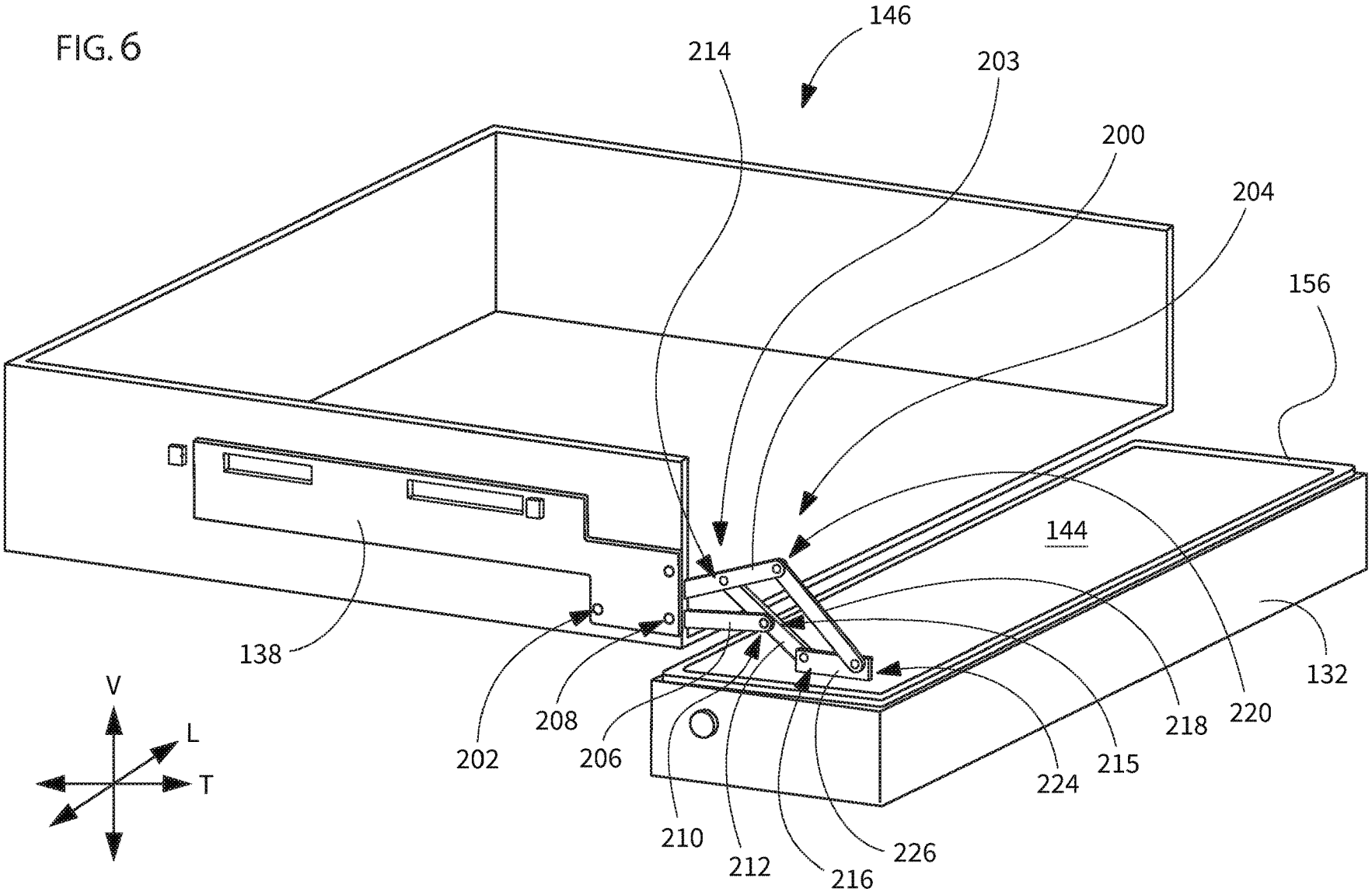
FIG. 6 provides a perspective view of the drawer of FIG. 2 with the door of the drawer in the open position.

Turning now to FIGS. 4 through 6, the linkage 140 may be a four bar linkage comprising, e.g., consisting of, four bars. In particular, the four bars may include a first bar 200, a second bar 206, a third bar 212, and a fourth bar 218. The first bar 200 may be connected to a side wall of the drawer body 146, e.g., to one of the left side wall 148 and the right side wall 152. The second bar 206 may be connected to the side wall (e.g., the same one of the side walls 148 and 152 to which the first bar 200 is connected) of the drawer body 146. The third bar 212 may be connected to the first bar 200, to the second bar 206, and to an inner surface 144 (FIGS. 5 and 6) of the door 132. The fourth bar 218 may be connected to the first bar 200 and to the inner surface 144 of the door 132.

As mentioned, the plurality of bars of the linkage 140 may be connected by pivot joints. For example, as illustrated in FIGS. 4 through 6, in some embodiments, the first bar 200 may be connected to the side wall 148 or 152 at a first end 202 of the first bar 200 by a first pivot joint 250 and the second bar 206 may be connected to the side wall 148 or 152 at a first end 208 of the second bar 206 by a second pivot joint 252. In some embodiments, for example as illustrated in FIGS. 4 through 6, the first pivot joint 250 and the second pivot joint 252 may be aligned along the vertical direction V. The first bar 200 may be connected to a first end 220 of the fourth bar 218 at a second end 204 of the first bar 200 opposite the first end 202 of the first bar 200 by a third pivot joint 254. The fourth bar 218 may be connected to the inner surface 144 of the door 132, such as a mounting bar 226 on the inner surface 144, at a second end 224 of the fourth bar 218 opposite the first end 220 of the fourth bar 218 by a fourth pivot joint 256. The third bar 212 may be connected, at a first end 214 thereof, to an intermediate point 203 of the first bar 200 between the first end 202 and the second end 204 of the first bar 200 by a fifth pivot joint 258. A second end 210 of the second bar 206 may be connected to the third bar 212 at an intermediate point 215 of the third bar 212 by a sixth pivot joint 260. The intermediate point 215 of the third bar 212 may be between the first end 214 of the third bar 212 and a second end 216 of the third bar 212 opposite the first end 214 of the third bar 212. The second end 216 of the third bar 212 may be connected to the inner surface 144 of the door 132, e.g., to the mounting bar 226 thereon, by a seventh pivot joint 262.

Figure 7:
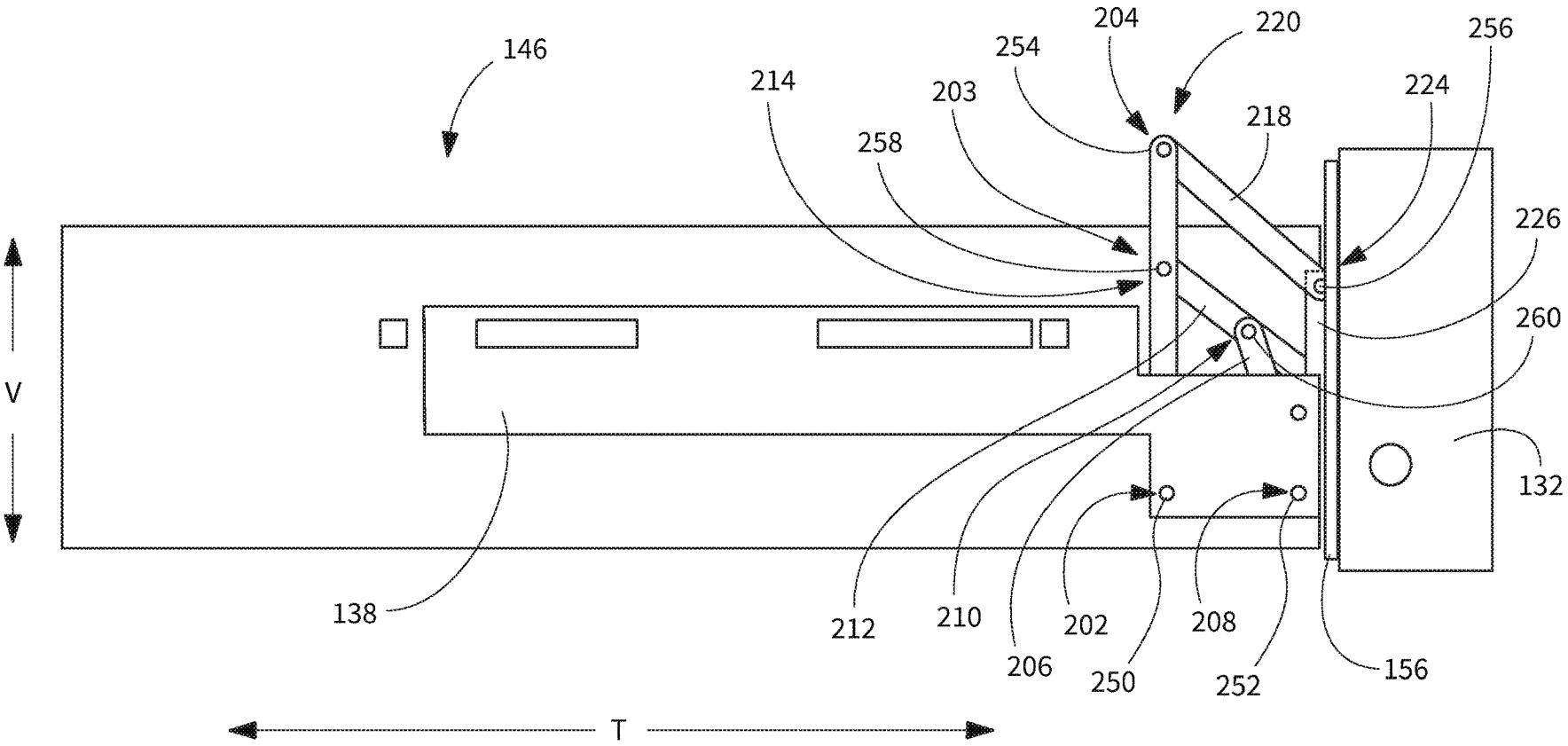
FIG. 7 provides a side view of the drawer of FIG. 2.
Figure 8:
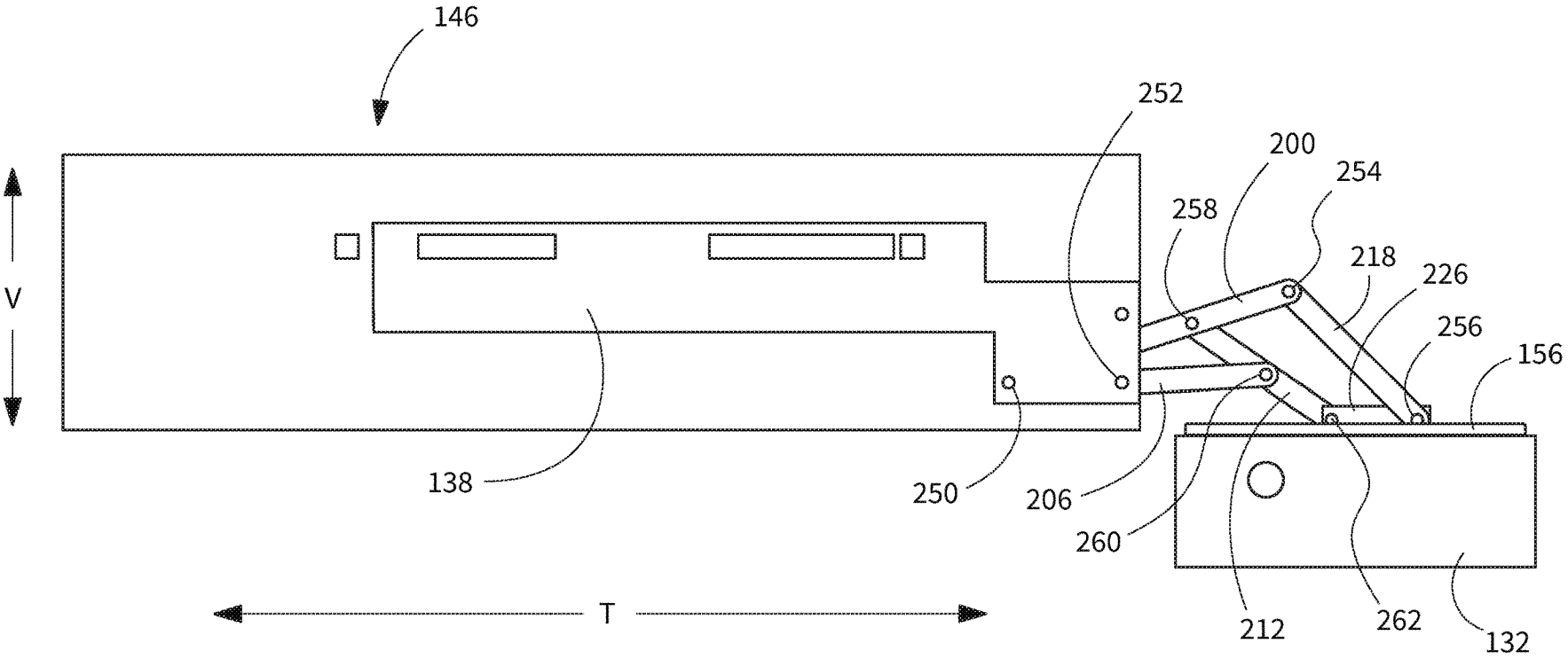
FIG. 8 provides a side view of the drawer of FIG. 2 with the door of the drawer in the open position.

The drawer 125 disclosed herein, in particular the door 132 and the linkage 140 which connects the drawer 125 to the drawer body 146, may provide several advantageous features, examples of which may be appreciated with respect to FIGS. 7 and 8 and the following description. For example, the linkage 140 may permit the door 132 to move relative to the drawer body 146 such that the inner surface 144 of the door 132 is parallel to, and in at least some embodiments, colinear or coplanar with, the floor 154 of the drawer 125 when the door 132 is in the open position (FIG. 8). Such alignment of the inner surface 144 of the door 132 with the floor 154 of the drawer 125 may advantageously promote ease of access to items stored within the interior 126 of the drawer 125. For example, larger items may be more easily slid into and out of the interior 126 of the drawer 125 via the inner surface 144 of the door 132 when the door 132 is in the open position and the inner surface 144 of the door 132 is aligned with the floor 154 of the drawer 125. As another example of an advantageous feature of the drawer 125, in some embodiments, the linkage 140 may provide extended useful life of the gasket 156. For example, the linkage 140 may permit the door 132 to move relative to the drawer body 146 between the closed position (FIG. 7) and the open position (FIG. 8) such that the door 132 is offset from the drawer body 146 through the range of motion from the closed position to the open position, and vice versa. Thus, the gasket 156 may clear the drawer body 146 while the door 132 moves to the open position and when the door 132 is in the open position, as well as from the open position to the closed position. Accordingly, rubbing of the gasket 156 on the drawer body 146 and concomitant wear on the gasket 156 when moving between the open and closed positions may be reduced or avoided. Additionally, the use of the linkage 140 to connect the door 132 to the drawer body 146 may provide a controlled gap between the door 132, e.g., the inner surface 144 thereof, and the drawer body 146 when the door 132 is in the open position, e.g., the lengths of the bars making up the linkage 140 may be selected to provide a short distance for items being slid into or out of the drawer 125 to span while also providing a large enough gap that the gasket 156 clears the drawer body 146, as described. The foregoing advantages are examples only and are not limiting, e.g., embodiments of the present disclose may also provide additional advantages as will be recognized by those of ordinary skill in the art.

Figure 9:
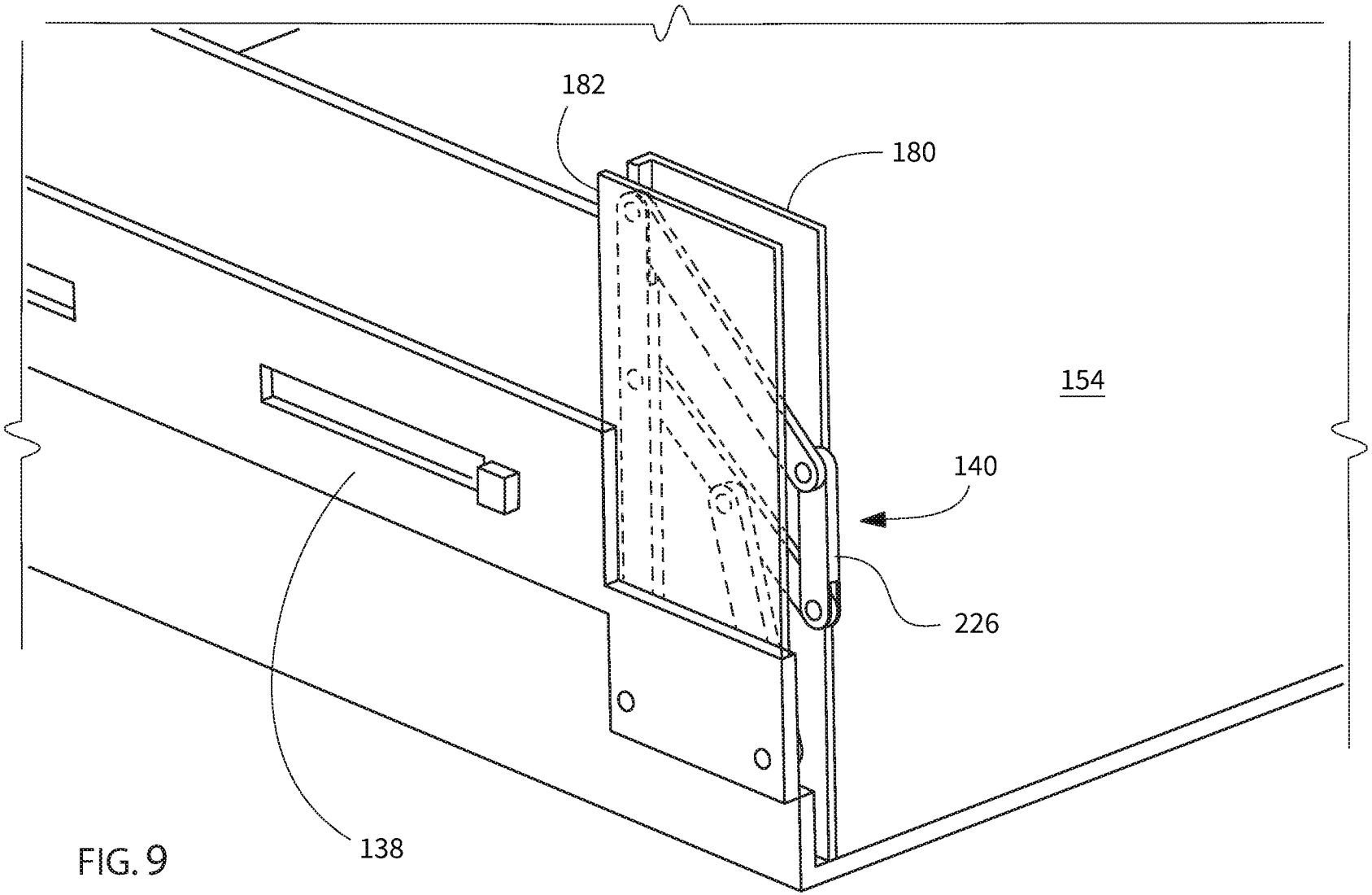
FIG. 9 provides an enlarged perspective view of a portion of a drawer body of the drawer of FIG. 2.

In some embodiments, e.g., as illustrated in FIG. 9, the drawer 125 may include a first concealing wall 180 and a second concealing wall 182 which extend from the side wall 148 or 152 and to or towards the door 132. As illustrated in FIG. 9, the linkage 140 may be positioned between the concealing walls 180 and 182. Thus, the concealing walls 180 and 182 may advantageously improve the aesthetics of the drawer 125 by hiding the linkage 140. Further, the concealing walls 180 and 182 may prevent objects, e.g., smaller food items, from imposing into the linkage 140, such as between the bars thereof, and interfering with movement of the door 132 between the open position and the closed position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a fresh food storage chamber and a frozen food storage chamber; and a drawer slidably mounted within one of the fresh food storage chamber and the frozen food storage chamber, the drawer comprising:

a drawer body defining an interior of the drawer; and a door attached to the drawer body via a linkage whereby the door is movable relative to the drawer body between a closed position where the door encloses the interior of the drawer and an open position to provide access to the interior of the drawer, wherein the linkage is a four-bar linkage comprising four bars interconnected by pivot joints, wherein the four bars of the linkage comprise a first bar connected to a side wall of the drawer body, a second bar connected to the side wall of the drawer body, a third bar connected to the first bar, the second bar, and an inner surface of the door, and a fourth bar connected to the first bar and the inner surface of the door, and wherein the first bar is connected to the side wall of the drawer body at a first pivot joint, the second bar is connected to the side wall of the drawer body at a second pivot joint, and the first pivot joint and the second pivot joint are colinear on a line that is oriented along the transverse direction.

2. The refrigerator appliance of claim 1, wherein the first bar is connected to the side wall of the drawer body at a first end of the first bar, the first bar is connected to the fourth bar at a second end of the first bar opposite the first end of the first bar, and the first bar is connected to the third bar at an intermediate point of the first bar.

3. The refrigerator appliance of claim 1, wherein the second bar is connected to the side wall of the drawer at a first end of the second bar and the second bar is connected to the third bar at a second end of the second bar opposite the first end of the second bar.

4. The refrigerator appliance of claim 1, wherein the third bar is connected to the first bar at a first end of the third bar, to the inner surface of the door at a second end of the third bar opposite the first end of the third bar, and to the second bar at an intermediate point of the third bar.

5. The refrigerator appliance of claim 1, wherein the drawer body comprises a floor and the door comprises an inner surface, wherein the inner surface of the door is perpendicular to the floor when the door is in the closed position and the inner surface of the door is parallel with the floor when the door is in the open position.

6. The refrigerator appliance of claim 1, further comprising a gasket on an inner surface of the door, wherein the gasket is clear of the drawer body when the door is in the open position.

7. The refrigerator appliance of claim 1, wherein the drawer body is slidably mounted to the cabinet via a slide, and wherein the linkage is connected directly to the slide.

8. A drawer for a refrigerator appliance, the refrigerator appliance comprising a cabinet defining a fresh food storage chamber and a frozen food storage chamber, the drawer configured for slidably mounting within one of the fresh food storage chamber and the frozen food storage chamber, the drawer comprising:

a drawer body defining an interior of the drawer; and a door attached to the drawer body via a linkage whereby the door is movable relative to the drawer body between a closed position where the door encloses the interior of the drawer and an open position to provide access to the interior of the drawer, wherein the linkage is a four-bar linkage comprising four bars interconnected by pivot joints, wherein the four bars of the linkage comprise a first bar connected to a side wall of the drawer body, a second bar connected to the side wall of the drawer body, a third bar connected to the first bar, the second bar, and an inner surface of the door, and a fourth bar connected to the first bar and the inner surface of the door, and wherein the first bar is connected to the side wall of the drawer body at a first pivot joint, the second bar is connected to the side wall of the drawer body at a second pivot joint, and the first pivot joint and the second pivot joint are colinear on a line that is oriented along the transverse direction.

9. The drawer for a refrigerator appliance of claim 8, wherein the first bar is connected to the side wall of the drawer body at a first end of the first bar, the first bar is connected to the fourth bar at a second end of the first bar opposite the first end of the first bar, and the first bar is connected to the third bar at an intermediate point of the first bar.

10. The drawer for a refrigerator appliance of claim 8, wherein the second bar is connected to the side wall of the drawer at a first end of the second bar and the second bar is connected to the third bar at a second end of the second bar opposite the first end of the second bar.

11. The drawer for a refrigerator appliance of claim 8, wherein the third bar is connected to the first bar at a first end of the third bar, to the inner surface of the door at a second end of the third bar opposite the first end of the third bar, and to the second bar at an intermediate point of the third bar.

12. The drawer for a refrigerator appliance of claim 8, wherein the drawer body comprises a floor and the door comprises an inner surface, wherein the inner surface of the door is perpendicular to the floor when the door is in the closed position and the inner surface of the door is parallel with the floor when the door is in the open position.

13. The drawer for a refrigerator appliance of claim 8, further comprising a gasket on an inner surface of the door, wherein the gasket is clear of the drawer body when the door is in the open position.

14. The drawer for a refrigerator appliance of claim 8, wherein the drawer body is slidably mounted to the cabinet via a slide, and wherein the linkage is connected directly to the slide.

* * * * *